United States Patent [19]

Catallo

[11] Patent Number: 4,924,563

[45] Date of Patent: May 15, 1990

[54] APPARATUS FOR MOVING FABRIC THROUGH A FABRIC PROCESSING STEP

[76] Inventor: Frank Catallo, 75 Channel Dr., Port Washington, N.Y. 11050

[21] Appl. No.: 230,353

[22] Filed: Aug. 10, 1988

[51] Int. Cl.[5] ..... D06C 3/02

[52] U.S. Cl. ..... 26/76; 26/86

[58] Field of Search ..... 26/76, 86, 89, 91

[56] References Cited

U.S. PATENT DOCUMENTS

| | | | |
|---|---|---|---|
| 2,673,384 | 3/1954 | Roberts | 26/86 |
| 2,831,234 | 4/1958 | Vits | 26/86 |
| 3,570,081 | 3/1971 | Catallo | 26/86 |
| 4,817,254 | 4/1989 | Poterala | 26/76 |

*Primary Examiner*—Andrew M. Falik

*Assistant Examiner*—Bradley K. DeSandro

*Attorney, Agent, or Firm*—Leo Fornero

[57] ABSTRACT

The disclosure is directed to improvements in tenter frames which typically function to move fabric through a fabric processing step which might be fabric curing or drying. The tenter frame contemplated herein includes various adjustable devices for optimizing the position of the fabric as it is being moved to thereby minimize or eliminate any distortions in the fabric construction which can occur in open-type knits, such as pattern distortions and the like. In addition, the apparatus utilizes a series of mechanical variable speed drives and controllers which are all synchronized with an electric driver motor to better control the operation of a tenter frame as it moves fabric through a processing step.

12 Claims, 2 Drawing Sheets

APPARATUS FOR MOVING FABRIC THROUGH A FABRIC PROCESSING STEP

BACKGROUND OF THE INVENTION

This invention relates to the art of moving fabric through a pre-selected processing step and apparatus for accomplishing this purpose is typically referred to as a tenter frame.

Normally, such a device includes a frame which serves to support a double chain and pin arrangement spaced from each other so that the edges of the fabric web may be placed on the pins in a desired fashion whereby any distortions in the fabric are minimal or eliminated.

More importantly, as the fabric is moved through the processing step or steps—and particularly as speed changes, stops and starts occur—it will be understood that this must be accomplished without any fabric distortion or other forms of fabric instability to speak of.

Improvements in the movement of fabric to minimize the above-mentioned distortions and the recurrence of instability have from time to time been made and are known in the prior art.

In particular, the significant gains made in computerization and the development of electronic and electrical improvements have provided—to a degree—various techniques to achieve the desired minimization of the damaging distortions in the fabric.

However, such electrical techniques have created a number of other deficiencies, such as the requirement to have available highly-skilled technical personnel to cope with breakdowns. Such equipment is also expensive, both from an operational and investment standpoint.

In electronic or electrical type systems—fabric quality is not maximized due to problems that may develop from the lag in response which generally occurs in this type system. This lag occurs particularly in systems which employ multiple motors which need to be synchronized.

SUMMARY OF THE INVENTION

Pursuant to the invention, a novel and improved tenter frame is provided and incorporates features which cooperate to assure that fabric quality consistency is achieved through a mechanical system wherein all drives and controllers are accurately synchronized to the main drive which may be a variable speed motor. In this manner, the minimization or elimination of distortions in the fabric and/or destabilization which may occur during the movement of said fabric is achieved.

More particularly, such benefits are now realized in a less-complicated and less-costly system than what is presently known in the art to me.

In its simplest form, the synchronized drive system of the present invention includes a variable speed motor which through a drive train moves the fabric web which has been selectively placed on the pins which are mounted on the spaced tenter chains. Usually, the other drive components are arranged at the fabric receiving end of the tenter frame wherein a fabric entry zone is formed and are as follows: a variable speed controller or transmission of the mechanical type which through an adjustable drive train having telescoping members and an idler sprocket on which the chain rides, cooperate to control the fabric movement. This control is accomplished in cooperation with a fabric feed arrangement shown as being driven by the variable speed transmission of this idler system.

Edge sensors are also mounted in the vicinity of the fabric receiving end of the tenter and act to cooperate in the positioning of the chains to pick up the fabric web edges and adjustable relative to the pinning wheels which position these adjusted web edges on the chain pins as is well known in the art.

Each of the oppositely disposed pinning wheels are connected through an adjustable drive train also comprised of telescoping and self aligning to other variable speed controllers or transmissions.

All of the last-mentioned transmissions are also connected to a fabric feed arrangement which is usually in roll form to move the fabric web to the fabric entry zone of the tenter frame.

As was mentioned above, all of the variable speed mechanical transmissions are mechanically synchronized with the motor which drives the chains to achieve optimum fabric movement and stability without the difficulties of past concepts and yet without the high costs and problems presented by the newer electronic systems. The self aligning adjustable drive trains provide flexibility in the types and sizes of fabric that may be processed.

Another object of this invention is to provide a tenter frame which includes mechanical controllers of the variable speed type operative along with the adjustable drive trains to achieve a device for processing fabric which is easy to manufacture, efficient in its operation and economical to make.

For a more complete understanding of the above and other features and advantages of the invention, reference should be made to the following detailed description of a preferred embodiment and to the accompanying drawings.

BRIEF DESCRIPTION OF THE DRAWINGS

In the drawings, like reference numerals denote corresponding parts throughout the several views.

GENERAL DESCRIPTION OF THE INVENTION

Figure 1:
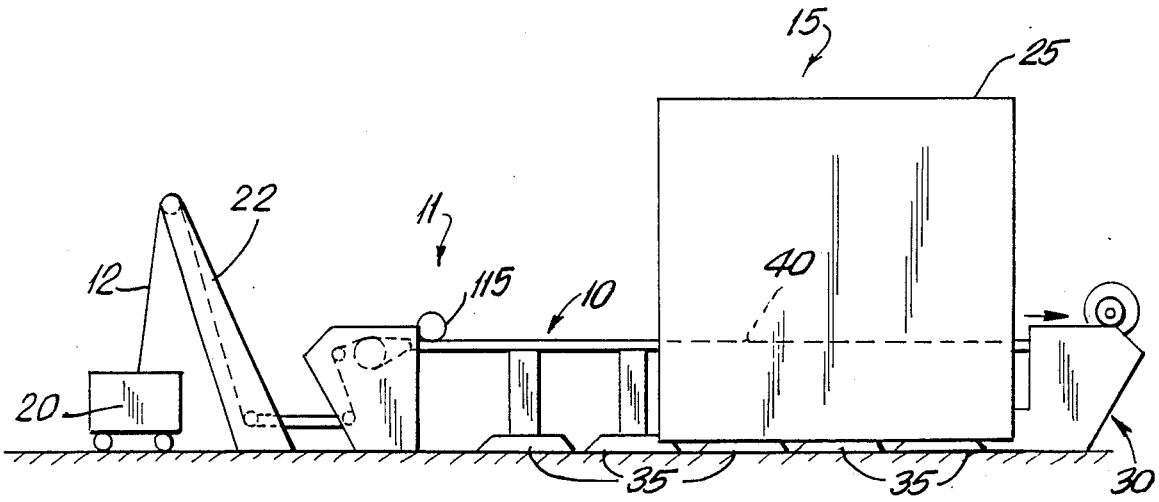
FIG. 1 is a partial schematic and partial side view of a fabric finishing line incorporating a tenter frame including the features in accordance with this invention.
Figure 2:
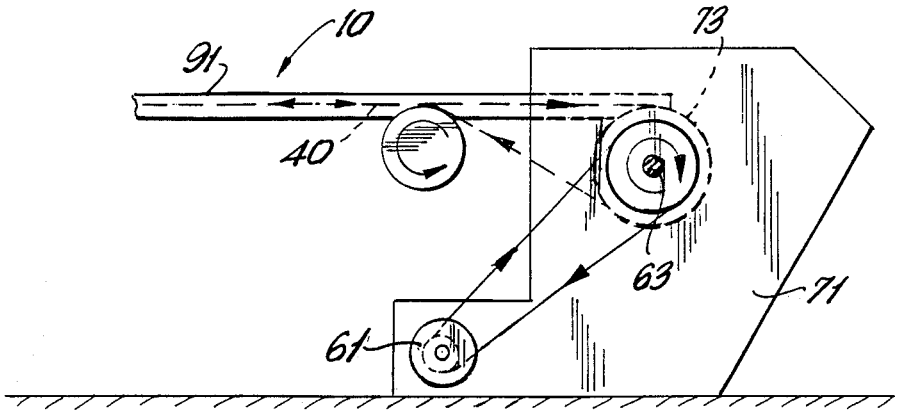
FIG. 2 is a partial side view of the driving portion showing a driving system of the type contemplated herein.
Figure 3:
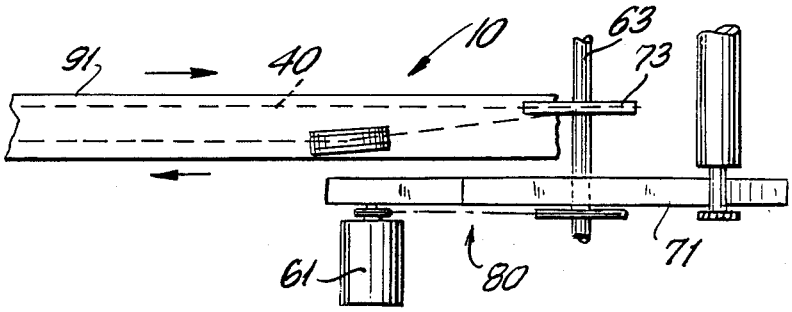
FIG. 3 is a partial top view of FIG. 2.

Referring to FIG. 1, there is shown a tenter frame 10 located in a typical fabric web processing line generally designated 15. The fabric web 12 enters the line 15 from the truck 20 and moves through entry stand 22 to the tenter frame 10 and proceeds on through a processing step, such as heat setting accomplished in chamber 25 and is then batched in batcher 30.

Figure 4:
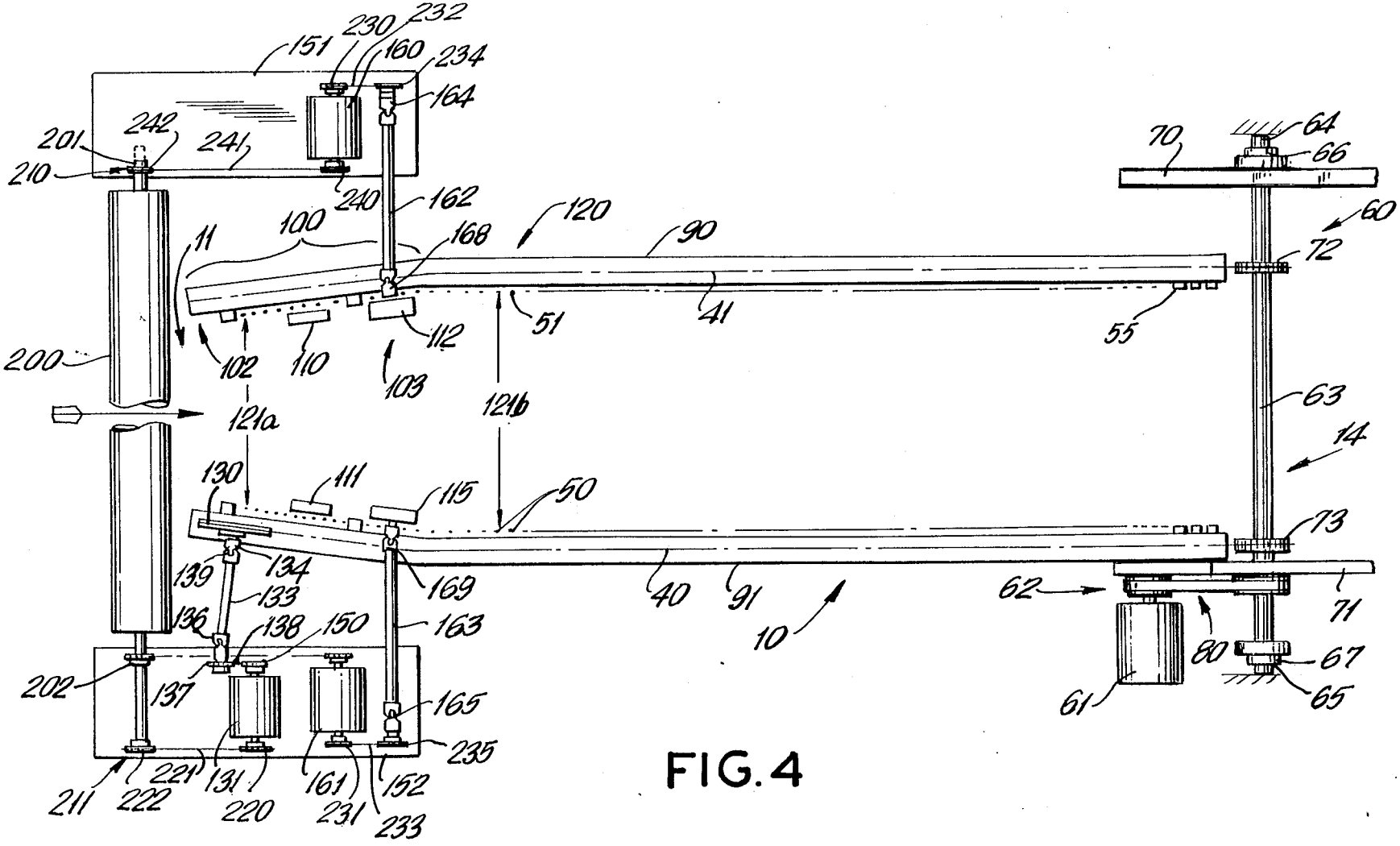
FIG. 4 is a schematic view showing the various mechanical drivers and the adjustable drive trains.

The tenter frame 10, comprises, as is shown in FIG. 4, as is well known in the art, a series of supports 35 on which are mounted spaced chains 40 and 41 including brackets 55 on which are mounted pins 50 and 51 for holding or gripping the fabric web and acting to move the fabric web through the chamber 25.

The tenter frame 10 at one end as is also shown in FIG. 4, and as is well known in the technology, forms a fabric receiving end 11 and at the other end forms a fabric delivery end 14. The fabric may be further processed or batched as is shown in FIG. 1.

At the fabric delivery end, there is disposed a system 60, FIG. 4, for driving the fabric web, which is usually placed on the chain and pin arrangement, as is well known; through a variable speed motor 61 and, for example, through a timing belt drive train designated 62 including a shaft 63 journaled at its ends 64 and 65 in bearings 66 and 67 and supported by frame members 70 and 71.

On shaft 63 are mounted sprockets 72 and 73 fixed thereto and adjustable widthwise thereon and placed so as to receive the means for gripping and moving the fabric web which are the usual chains 40 and 41 and pins 50 and 51 driven by the sprockets, as is well known. Variable speed motor 61 is fixed to the frame or support 71 and drives the shaft through a pulley and belt arrangement designated 80. The motor speed may be set as desired to optimize the movement of the fabric web to achieve the desired process conditions.

At the fabric receiving end 11, the chains 40 and 41 and pins 50 and 51, mounted in chain brackets 55, as they move in rail housings 90 and 91, follow a spaced, generally parallel path in the housings, as is well known in tenter frame technology, and are disposed to form a fabric entry zone 100. This zone has at one end a front entry end 102 and at the other end a rear guiding end 103. Also in FIG. 4, the fabric web receiving end 11 includes the fabric entry zone 100 which functions to move fabric from one width 121*a* as shown to another width 121*b*. This is easily accomplished by hinging the housing so that it may be adjusted to one dimension at the front entry end 102 and a different dimension 121*a* at the rear guiding end 103. Preferably, the fabric moves from a narrow width to a wider width as is shown in the drawings. But if desired, the fabric may move from a wider width to a narrower one.

Located in the fabric entry zone 100 are the oppositely disposed edge sensing means 110 and 111, the pinning means 112 and 115 and these pinning means are adjustably connected to the variable speed transmissions of the mechanical type as is shown in FIG. 4. The edge sensing means employed, as is well known in the art, to adjust the web fabric to the pinning means.

More particularly, a key function of spreading the fabric web to achieve the objectives outlined herein occurs in the fabric entry 100. Of course, mechanical speed synchronization of the transmission systems with the variable speed motor 61 when the web has moved into the main portion of the tenter at 120 starting at a location where the rail housing and chains start taking on a parallel configuration and located between the rear guiding end 103 and the fabric delivery end 14, is also provided to cooperate to achieve the results contemplated by this invention.

Also located in the fabric entry zone 100 is an idler sprocket arrangement to cooperate with the variable speed driver or motor arrangement 60 to optimize the chain pin system operation during starting, stopping and also during speed changes which may occur during fabric web processing.

The idler arrangement comprises an idler 130 which is adjustable relative to its transmission 131, of the variable speed type, through an adjustable drive train which includes a movable tube 133 which may be in the form of a square moving inside a larger square member. The stability of the tube 133 may also be achieved through a splined tube system not shown. The tube, which takes the form of telescoping components or members, at one end 134 is connected through any suitable form of adjustable coupling 136 or universal joint to the variable speed transmission 131. The tube 133 and adjustable coupler 136 provide the desired self aligning feature.

In the form shown in FIG. 4, the coupling 136 is connected to a sprocket or pulley 137 and then through chain or belt 138 and sprocket or pulley 150 to the transmission 131. At the other end, the transmission is connected through a universal joint 139 to the idler sprocket 130. The opposite end of transmission 131 is connected to end 211 of feed roll 200 through sprocket 220, chain 221 which is connected to sprocket 222 mounted on said feed roll.

Adjustment of the fabric entry zone through the movability provided at the front entry end 102 through the hinge arrangement at the rear guiding end 103 is achieved to obtain the most efficient mode of operation.

Also located in the fabric entry zone are the edge sensing means 110 and 111 which function to adjust the fabric entry zone to pick up the fabric edges as desired and as will be understood by those skilled in the art, and move same in an adjusted fashion and in a normally straight track to the pinning wheels or brushes 112 and 115.

The pinning wheels preferably located near the rear guiding end 103 of the fabric entry zone 100 operate to place the fabric firmly on the means for gripping and moving same as the fabric is about to be transported into the main section of the tenter frame. These means comprise the chains and pins utilized on any wellknown type of tenter frame.

The pinning wheels 112 and 115 are also driven through the variable speed transmissions 160 and 161 which are fixedly mounted on supports 151 and 152 and are interconnected to the pinning wheels through a drive train which is adjustable relative to the distance from each of the supports 151 and 152 and the chains at the rear guiding end 103. This is accomplished in the same fashion as was the case mentioned hereinabove with the adjustable drive of the idler system.

That is, there are movable tubes 162 and 163 interconnected to adjustable couplers 164 and 165 each of which is connected to its respective transmission at one end and at the other end each coupler is connected to its respective pinning wheel through universal joints 168 and 169. The transmissions 160 and 161 are fixed to supports 151 and 152. Any support system known in the art may be used for all of the adjustable tube arrangements 133, 162 and 163.

The transmissions 160 and 161 are connected to the respective tubes 162 and 163 by means of sprockets and chains. A sprocket 230 is mounted on transmission 16 and sprocket 231 is mounted on transmission 161.

The control is effected through chains 232 and 233 as they are connected respectively to sprockets 234 and (235) mounted on the ends of tubes 162 and 163 of the pinning wheels.

The transmission 160 is connected to the feed roll 200 at its end 210 through a sprocket 240 and chain 241, sprocket 242 arrangement also.

The feed roll 200 is journaled in bearings 201 and 202 mounted in supports 151 and 152 to move fabric to the delivery end of the tenter as is shown in FIG. 4.

The operation and driving system for the mechanical components located in the fabric entry zone 100 and the fabric delivery end are as follows: one end 211 of the feed roll 200 is connected to the variable speed transmission 131 and powered by this transmission or controller as described above. In similar fashion, the transmission or controller 160 is also connected to and driven by the end 210 of the feed roll 200.

The variable speed transmission 161 of pinning wheel 115 is connected to the other end 211 of the feed roll 200. It is clear that connection of these mechanical members may be achieved through a system of chains or belts and interconnecting pulleys or sprockets as is shown and described above.

In operation, the various transmissions of the mechanical variable speed type cooperate with the adjustable drive trains and when synchronized with the motor drive cooperate to permit accurate running of the fabric regardless of whether such fabric is moving, starting, stopping or changing speed—which has been indicated as being highly desirable herein.

It should be understood, of course, that the specific forms of the invention herein illustrated and described are intended to be representative only as certain changes may be made in the invention without departing from the clear teachings of the disclosure. Accordingly, reference should be made to the following appended claims determining the full scope of the invention.

I claim:

1. A tenter frame comprising (a) a fabric web receiving end;

(b) a fabric web delivery end, (c) means for gripping and moving a fabric web through a fabric processing step, (d) a housing means for the means for gripping and moving the fabric web, (e) means disposed on the housing and associated with the means for gripping and moving the fabric web and said means located between the fabric web receiving end and the fabric web delivery end to form a fabric entry zone, (f) said fabric entry zone having a front entry end and a rear guiding end, (g) said fabric entry zone being adjustable relative to the rear guiding end to adjust the front entry end to optimize the placement of said fabric web on said means for gripping and moving the fabric web, (h) delivery means associated with said housing means for delivering said fabric web to the front entry end of the fabric entry zone, (i) mechanical variable speed means for the delivery means, (j) a drive train connected to the means for gripping and moving the fabric web to cooperate therewith to move the fabric web at pre-selected speeds through a processing step, (k) a variable speed motor connected to said drive train, (l) pinning means mounted relative to the rear guiding end of the fabric entry zone and relative to said means for gripping and moving the fabric web for receiving and placing said fabric web on said means for gripping and moving said fabric web, (m) mechanical variable speed means for the pinning means, (n) fabric edge sensing means disposed in said fabric entry zone to adjust said fabric web relative to said pinning means.

(o) an idler member adjustably connected in self aligning fashion to the means for gripping and moving the fabric web, (p) mechanical variable speed means for the idler member cooperating with said variable speed motor to optimize the movement of said fabric web through said pre-selected processing step, (q) the variable speed motor set to operate at a preselected speed, (r) the mechanical variable speed means for the delivery means, the pinning means and the idler member, all being synchronized to the variable speed motor.

2. The tenter frame according to claim 1 wherein the mechanical variable speed means for the idler member is connected to the delivery means.

3. The tenter frame according to claim 1 wherein the pinning means comprises two oppositely disposed units each having separate mechanical variable speed means interconnected thereto by separate adjustable members which are movable to facilitate the processing of fabric webs of different dimension.

4. The tenter frame according to claim 1 wherein the mechanical variable speed means of said pinning means and said idler member are all connected to said delivery means.

5. The tenter frame according to claim 1 wherein said means for gripping and moving the fabric web are driven by an electric motor and said means for gripping and moving the fabric web drives said idler member through its associated variable speed means to drive said delivery means which drives said pinning means through its mechanical variable speed means and said motor and all of said variable speed means being synchronized to optimize the processing of said fabric.

6. The tenter frame of claim 3 wherein the idler member comprises a mechanical variable speed means and a sprocket member connected to the means for gripping and moving the fabric web and said mechanical variable speed means and said sprocket member being interconnected by an adjustable member which facilitates the processing of fabrics of different dimensions.

7. A tenter frame comprising (a) a fabric web receiving end, (b) a fabric web delivery end, (c) means for gripping and moving a fabric web through a fabric processing step, (d) a housing means for the means for gripping and moving the fabric web, (e) means disposed on the housing and associated with the means for gripping and moving the fabric web and said means located between the fabric web receiving end and the fabric web delivery end to form a fabric entry zone, (f) said fabric entry zone having a front entry end and a rear guiding end, (g) said fabric entry zone being adjustable relative to the rear guiding end to adjust the front entry end to optimize the placement of said fabric web on said means for gripping and moving the fabric web, (h) delivery means associated with said housing means for delivering said fabric web to the front entry end of the fabric entry zone, 21 (i) mechanical variable speed means for the delivery means, (j) a drive train connected to the means for gripping and moving the fabric web to cooperate therewith to move the fabric web at pre-selected speeds through a processing step, (k) a variable speed motor connected to said drive train, (l) pinning means mounted relative to the rear guiding end of the fabric entry zone and relative to said means for gripping and moving the fabric web for receiving and placing said fabric web on said means for gripping and moving said fabric web, (m) mechanical variable speed means for the pinning means, (n) fabric edge sensing means disposed in said fabric entry zone to adjust said fabric web relative to said pinning means.

(o) an idler member adjustably connected in self aligning fashion to the means for gripping and moving the fabric web, (p) mechanical variable speed means for the idler member cooperating with said variable speed motor to optimize the movement of said fabric web through said pre-selected processing step, (q) a first self-adjusting drive train connected in self aligning fashion at one end to said pinning means and at the other end connected to said mechanical variable speed means of said pinning means to cooperate with said variable speed motor to optimize operation of said means for gripping and moving said fabric web, (r) a second self-adjusting drive train connected in self aligning fashion at one end to said idler member and at the other end to said mechanical variable speed means of said idler member to cooperate with said variable speed means to optimize operation of said means for gripping and moving said fabric web, (s) the variable speed motor being set to operate at a pre-selected speed, (t) the mechanical variable speed means for the delivery means, the pinning means and the idler member, all being synchronized to the variable speed motor.

8. The tenter frame according to claim 7 wherein the mechanical variable speed means for the idler member is connected to the delivery means.

9. The tenter frame according to claim 7 wherein the pinning means comprises two oppositely disposed units each having separate mechanical variable speed means interconnected thereto by separate adjustable members which are movable to facilitate the processing of fabric webs of different dimension.

10. The tenter frame according to claim 7 wherein the mechanical variable speed means of said pinning means and said idler member are all connected to said delivery means.

11. The tenter frame according to claim 7 wherein said means for gripping and moving the fabric web are driven by an electric motor and said means for gripping and moving the fabric web drives said idler member through its associated variable speed means to drive said delivery means which drives said pinning means through its mechanical variable speed means and said motor and all of said variable speed means being synchronized to optimize the processing of said fabric.

12. The tenter frame of claim 9 wherein the idler member comprises a mechanical variable speed means and a sprocket member connected to the means for gripping and moving the fabric web and said mechanical variable speed means and said sprocket member being interconnected by an adjustable member which facilitates the processing of fabrics of different dimensions.

* * * * *